United States Patent [19]

Tachibana et al.

[11] 4,151,715

[45] May 1, 1979

[54] EXHAUST GAS PURIFICATION SYSTEM

[75] Inventors: Hirotaka Tachibana; Hayao Matsuoka, both of Hiroshima, Japan

[73] Assignee: Toyo Kogyo Co., Ltd., Hiroshima, Japan

[21] Appl. No.: 836,906

[22] Filed: Sep. 26, 1977

[30] Foreign Application Priority Data

Oct. 4, 1976 [JP] Japan ..... 51-119666

[51] Int. Cl.[2] ..... F02M 25/06; F01N 3/10

[52] U.S. Cl. ..... 60/278; 60/293; 60/304; 123/119 A

[58] Field of Search ..... 123/119 A; 60/278, 282, 60/293, 304, 308, 305

[56] References Cited

U.S. PATENT DOCUMENTS

| | | | |
|---|---|---|---|
| 3,500,807 | 3/1970 | Daigh | 60/278 |
| 3,613,359 | 10/1971 | Posh et al. | 60/308 |
| 3,653,212 | 4/1972 | Gast et al. | 60/293 |
| 3,751,915 | 8/1973 | Ranft et al. | 60/308 |
| 3,776,207 | 12/1973 | Simko | 123/119 A |
| 3,938,330 | 2/1976 | Nakasima et al. | 60/323 |
| 4,056,933 | 11/1977 | Nohira et al. | 60/278 |
| 4,068,628 | 1/1978 | Duckworth | 123/119 A |
| 4,084,372 | 4/1978 | Kuroda et al. | 60/305 |

*Primary Examiner*—Wendell E. Burns
*Attorney, Agent, or Firm*—Wenderoth, Lind & Ponack

[57] ABSTRACT

An exhaust gas purification system for use in an internal combustion engine equipped with a dual exhaust system. The exhaust gas purification system includes a secondary air supplying port of a secondary air supplying passage opened into a selected exhaust pipe belonging to one of first and second exhaust pipe groups, while an exhaust gas deriving port of an exhaust gas recycling passage for recycling the exhaust gases to a downstream of the carburetor throttle valve is provided in another exhaust pipe belonging to the other of the first and second exhaust pipe groups for effective suppression of $NO_x$ through accurate control of the amount of exhaust gases to be recycled.

9 Claims, 2 Drawing Figures

EXHAUST GAS PURIFICATION SYSTEM

Figure 1:
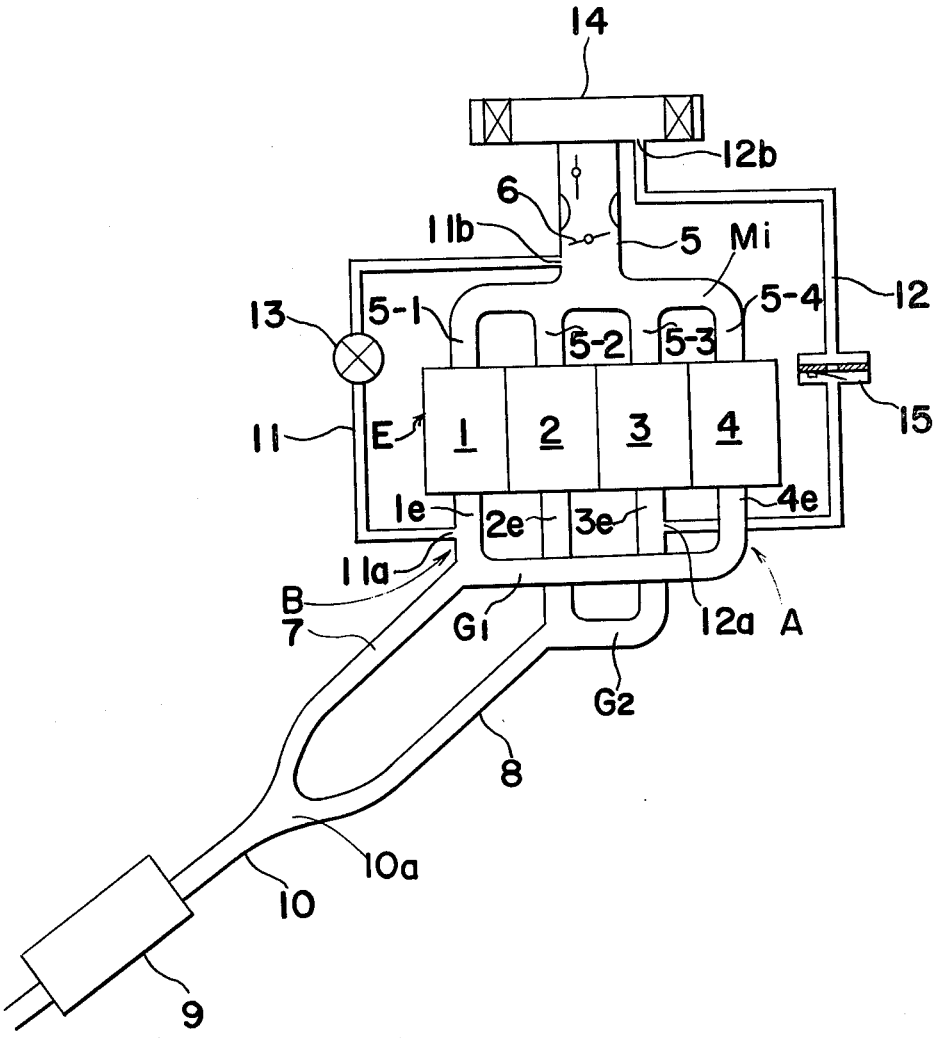

The present invention relates to an exhaust gas purification system and more particularly, to a combination of an exhaust gas recycling means and secondary air supplying means or arrangements thereof for a dual exhaust system in an internal combustion engine equipped with such a dual exhaust system.

Conventionally, for the purification of exhaust gases containing unburned noxious compounds such as nitrous oxides, carbon monoxide, hydrocarbons, etc., there has been known a technical concept in which formation especially of nitrogen oxides or $NO_x$ is suppressed through reduction of the highest combustion temperature of an air-fuel mixture by recycling a portion of exhaust gases discharged from an engine to the air-fuel mixture to be introduced into the engine (i.e., the so-called EGR (Exhaust gas recycling) system), with simultaneous introduction of a secondary air into the exhaust system for suppressing the unburned noxious compounds such as CO, HC and the like in the exhaust gases to a minimum amount.

In the exhaust gas purification system of the above described type, however, there have been various problems inherent in it such as reduction of engine output following the recycling of the exhaust gases, difficulty for sufficiently suppressing the undesirable unburned noxious compounds especially $NO_x$ due to mixing of secondary air into the recycled exhaust gases resulting from adverse effect produced between the exhaust gas recycling means and secondary air supplying means when the latter is simultaneously employed.

One type of such a known arrangement is disclosed, for example, in U.S. Pat. No. 3,500,807, issued Mar. 17, 1970 in which the secondary air is introduced into the exhaust system of the internal combustion engine which is not equipped with the dual exhaust system, while the exhaust system is connected to the intake passage at the downstream of the throttle valve for recycling the exhaust gases to the latter. In this prior art, the secondary air is not supplied to the portion of the exhaust system from which the exhaust gases are recycled. The known arrangement as described above, however, has such disadvantages that since the engine is not provided with the dual exhaust system, there are still various problems related to interference of exhaust gases between the exhaust pipes, undesirable reduction of the engine output, etc.

Meanwhile, as an exhaust system of an engine, there has been known the dual exhaust system in which exhaust pipes of cylinders whose ignition sequences are not continuous are classified into two groups for collecting the exhaust pipes in each of the groups into first and second connecting pipes respectively, while the first and second connecting pipes are further collected into an exhaust line opened at its one end into the atmosphere. The dual exhaust system as described above has such advantages that the engine output performance is improved with a higher scavenging efficiency for exhaust gases through prevention of interference between the exhaust pipes, and that owing to the increased exhaust pulsation in each of the groups of exhaust pipes, the system is particularly effective when the so-called spontaneous suction type secondary air supplying means is employed for introducing a sufficient amount of secondary air into the exhaust system through utilization of the exhaust pulsation.

Accordingly, an essential object of the present invention is to provide an exhaust gas purification system for use in an internal combustion engine equipped with a dual exhaust system so as to improve the engine output and to compensate for reduction in the engine output due to exhaust gas recycling in which, with effective utilization of the exhaust characteristics of the dual exhaust system, a secondary air supplying means and an exhaust gas recycling means are properly arranged so that the exhaust gases required for drastic suppression of $NO_x$ over the entire range of the engine operation are positively recycled to the engine intake system substantially irrespective of the secondary air to be supplied to the exhaust system.

Another important object of the present invention is to provide an exhaust gas purification system of the above described type in which a position for deriving the exhaust gases for recycling is properly set in the exhaust pipe belonging to one of two exhaust pipe groups of the dual exhaust system and a position for a secondary air supplying port is set in the exhaust pipe belonging to the other of two exhaust pipe groups of dual exhaust system.

A further object of the present invention is to provide an exhaust gas purification system of the above described type which is simple in construction and accurate in functioning, and can be readily incorporated into the internal combustion engines of the kind at low cost.

In accomplishing these and other objects according to one preferred embodiment of the present invention, in an internal combustion engine equipped with a dual exhaust system, a supplying port for a secondary air is opened in a selected exhaust pipe belonging to one of first and second exhaust pipe groups, while in another exhaust pipe belonging to the other of the first and second exhaust pipes, there is provided an exhaust gas deriving port for recycling the exhaust gases to an intake passage at a downstream of the carburetor throttle valve, by which arrangement, it has become possible to achieve an exhaust gas recycling ratio of high level, through introduction of necessary secondary air, with the engine output being maintained by the dual exhaust system, while the exhaust gases are adapted to be recycled to the downstream or upstream of the carburetor throttle valve without being influenced by the introduction of the secondary air, thus effective suppression of $NO_x$ being achieved through accurate control of the amount of the recycled exhaust gases.

Figure 2:
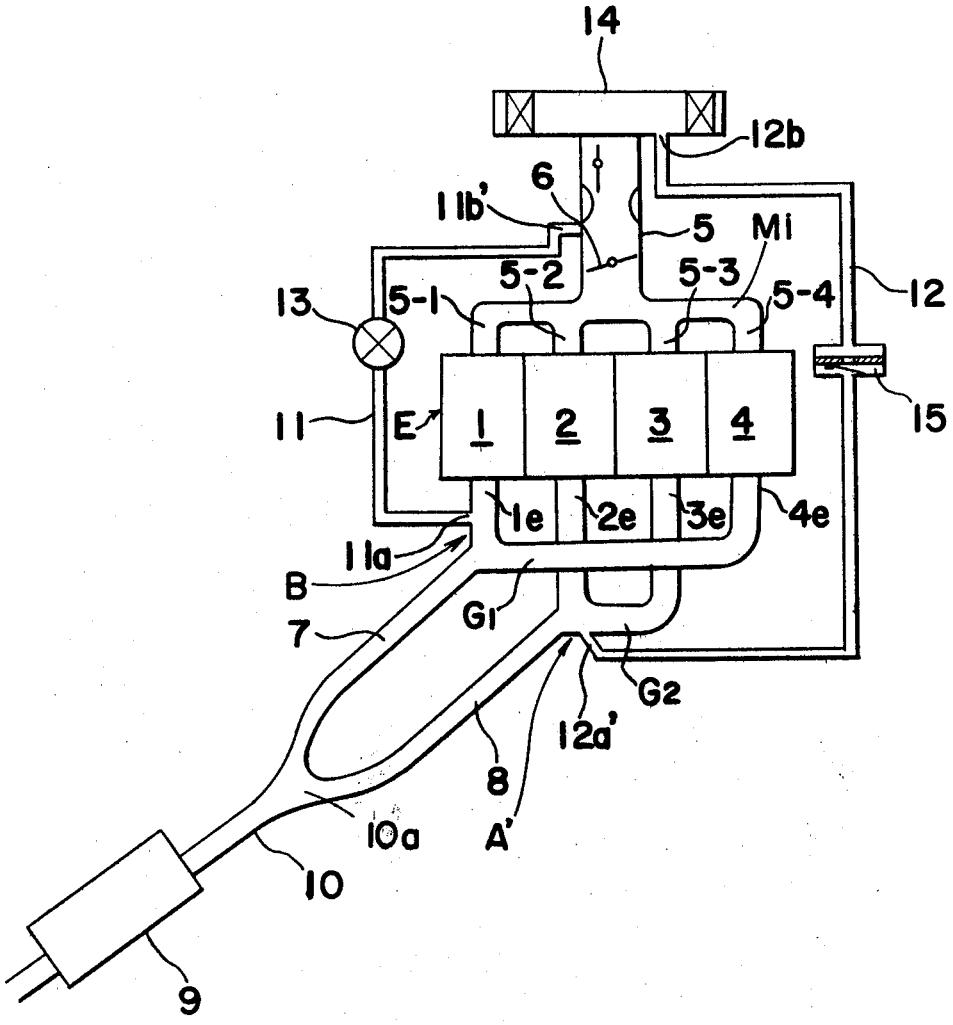

These and other objects and features of the present invention will become apparent from the following description taken in conjunction with the preferred embodiment thereof with reference to the accompanying drawings in which;

FIG. 1 is a schematic diagram showing a construction of a four-cylinder internal combustion engine to which an exhaust gas purification system of the present invention is applied, and FIG. 2 is a similar view to FIG. 1, but particularly shows a modification thereof.

Before the description of the present invention proceeds, it is to be noted that like parts are designated by like reference numerals throughout several views of the accompanying drawings.

Referring now to the drawings, there is shown in FIG. 1 a four-cylinder internal combustion engine E in which an air-fuel mixture introduced through an air filter or air cleaner 14 is supplied into each of cylinders 1, 2, 3 and 4 through a common intake line or intake passage 5 and via passages 5-1, 5-2, 5-3 and 5-4 of an intake manifold Mi branched at a downstream of a carburetor throttle valve 6. It is to be noted here that in the four-cylinder engine of the above described type, ignition normally takes place, for example, in the order of the cylinders 1, 3, 4 and 2. Meanwhile, exhaust pipes 1*e*, 2*e*, 3*e* and 4*e* for the respective cylinders 1 to 4 are classified into first and second groups G1 and G2, in each of which the exhaust pipes whose ignition sequences are not continuous, for example, the exhaust pipes 1*e* and 4*e*, and 2*e* and 3*e* are combined, and the exhaust pipes 1*e* and 4*e* belonging to the first exhaust pipe group G1 and the exhaust pipes 2*e* and 3*e* belonging to the second exhaust pipe group G2 are once collected into a first connecting pipe 7 and a second connecting pipe 8 respectively, while the first and second connecting pipes 7 and 8 are further collected at a junction 10a thereof into a lead-out pipe 10 leading to the atmosphere so as to form the so-called dual exhaust system on the whole. A catalysis type purification device 9 is provided in the lead-out pipe 10.

In the present invention in which the exhaust characteristics of the dual exhaust system as described above are taken into account, there is provided a secondary air supplying port 12*a* of a secondary air supplying passage 12 in an exhaust pipe which belongs to either one of the first exhaust pipe group G1 of second exhaust pipe group G2, for example, at an intermediate position A of the exhaust pipe 3*e* of the second group G2, while, in another exhaust pipe belonging to the other of the first and second exhaust pipe groups G1 and G2, for example, at an intermediate position B of the exhaust pipe 1e belonging to the first group G1 a downstream exhaust gas deriving port 11*a* for an exhaust gas recycling passage 11 is provided, with an exhaust gas recycling port 11*b* of said recycling passage 11 being opened into the intake passage 5 downstream of the carburetor throttle valve 6, taking into consideration that at the downstream of the carburetor throttle valve 6, negative intake pressure is large and the exhaust gas recycling can be effected approximately irrespective of the exhaust pulsation. Meanwhile, in the course of the exhaust gas recycling passage 11 in which the exhaust gas deriving port 11*a* is formed at the position B in the exhaust pipe 1*e* of the first exhaust pipe group G1 there is provided a control valve 13 which opens the recycling passage 11 for starting the exhaust gas recycling, for example, when the temperature of water for cooling the engine E has exceeded a predetermined set temperature or properly reduces or increases the amount of exhaust gas recycling depending on the amount of intake air-fuel mixture. For the control valve 13, control valves of the kind with any known construction may be employed.

On the other hand, the secondary air supplying passage 12 whose supplying port 12*a* is formed in the exhaust pipe 3*e* which belongs to the second exhaust pipe group G2 different from the first exhaust pipe group G1 has its secondary air inake port 12*b* opened into the air cleaner 14, while a check valve 15 which opens by the negative pressure and closes by the positive pressure of the exhaust pulsation in the exhaust pipe 3*e* is provided in the course of the secondary air supplying passage 12 so as to directly utilizes the exhaust pulsation built up in the exhaust pipe 3*e* for introducing the secondary air from the side of the air cleaner 14 into the second exhaust pipe group G2. The secondary air thus introduced into the second exhaust pipe group G2 by the exhaust pulsation flows through the second connecting pipe 8 together with the exhaust gas, and after having joined the exhaust gases flowing through the first connecting pipe 7, is introduced into the catalysis type purification device 9. It should be noted here that in this case, since the exhaust gas deriving port 11*a* of the exhaust recycling passage 11 is separated from the secondary air supplying port 12*a* of the secondary air supplying passage 12 by the first and second connecting pipes 7 and 8, the secondary air is scarcely mixed into the recycling exhaust gases. On the contrary, as considered from the viewpoint of supplying of the secondary air, the second exhaust pipe group g2 is free from influence due to deriving of the exhaust gases, and accordingly, correct supplying amount of the secondary air is secured for efficient exhaust gas purification.

As is clear from the foregoing description, the exhaust gas purification system of the invention is particularly characterized in that, in the internal combustion engine equipped with the dual exhaust system, the secondary air is arranged to be supplied into selected one of the first and second exhaust pipe groups, while the exhaust gases to be recycled are taken out from the other of the first and second exhaust pipe groups. According to the present invention, since the secondary air is not easily mixed into the recycled exhaust gases, not only the exhaust gas recycling amount is accurately controlled, but diameter of the pipe constituting the exhaust gas recycling passage can be so reduced as to be sufficient for the purpose. Furthermore, since the position for deriving the recycling exhaust gases can be set in the exhaust pipe group close to the engine, the length of the exhaust gas recycling passage is advantageously limited to a minimum required, while, due to the fact that the secondary air intake side is free from influence with respect to the exhaust pulsation, a sufficient amount of the secondary air can be correctly supplied. Therefore, according to the present invention, a drastic suppression of the undesirable $NO_x$ is achieved through recycling of an ample amount of exhaust gases, with simultaneous sufficient and correct supplying of the secondary air, while the high engine output performance is maintained by the employment of the dual exhaust system, thus an extremely effective exhaust gas purification system for internal combustion engines being advantageously presented.

It should be noted here that in the foregoing embodiment, although the exhaust gases are described as recycled to the intake passage 5 at the downstream of the carburetor throttle valve 6, the arrangement may be so modified as to recycle the exhaust gases to the intake passage 5 at the upstream of the carburetor throttle valve 6 as described hereinbelow with reference to FIG. 2.

Referring now to FIG. 2, there is shown a modification of the exhaust gas purification system of FIG. 1. In this modification, the exhaust gas recycling port 11*b* described as formed in the intake passage 5 at the downstream of the carburetor throttle valve 6 in FIG. 1 is modified to be opened into the same intake passage 5 at the upstream of the carburetor throttle valve 6 as shown at 11*b*', while the secondary air supplying port 12*a* also described in FIG. 1 as formed at the position A in the exhaust pipe 3e of the second exhaust pipe group G2 is so modified as to be opened in a position A' adjacent to a junction of the exhaust pipes 2*e* and 3*e* of the second exhaust pipe group G2 and also of the second connecting pipe 8 as shown at 12*a*'.

It should be noted here that the secondary air supplying port 12*a'* may of course be further modified to be formed in the position A of the secondary air supplying port 12*a* of FIG. 1, i.e., at the intermediate portion of the exhaust pipe 3*e* of the second exhaust pipe group G2 in the similar manner as in the arrangement of FIG. 1.

It should also be noted here that, when the arrangement of FIG. 1 wherein the exhaust gas recycling port 11b is opened into the downstream of the carburetor throttle valve 6 is compared with that of FIG. 2 wherein the exhaust recycling port 11*b'* is formed in the upstream of the same carburetor throttle valve 6, the former, i.e., the arrangement of FIG. 1 is more advantageous than the latter arrangement of FIG. 2, since at the downstream of the carburetor throttle valve 6, the intake negative pressure is large, with less influence by the exhaust pulsation. Since other construction and function of the arrangement of FIG. 2 are similar to those of the arrangement of FIG. 1, detailed description thereof is abbreviated for brevity.

It should further be noted that the spontaneous suction type secondary air supplying means described as employed in the foregoing embodiments of FIGS. 1 and 2 may be replaced by other types of secondary air supplying means, for example, by a secondary air supplying means of air pump, although employment of the spontaneous suction type secondary air supplying means as described with reference to FIGS. 1 and 2 is advantageous since the construction of the purification system is simplified with consequent reduction in cost.

Although the present invention has been fully described by way of example with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. In an internal combustion engine having an exhaust system which includes first and second exhaust pipe groups each formed by collecting, at one junction, exhaust pipes for cylinders whose ignition sequences are not continuous, of the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having is other end opened into atmosphere, an exhaust gas purification system for use in said internal combustion engine which comprises a secondary air supplying port formed at one end of a secondary air supplying passage and opened into one exhaust pipe group selected from said first and second exhaust pipe groups, and an exhaust gas recycling passage having at its one end an exhaust gas deriving port opened into the other exhaust pipe group of said first and second exhaust pipe groups so as to recycle part of the exhaust gases from the exhaust system to an intake passage provided therein with a carburetor throttle valve of said internal combustion engine, through an exhaust gas recycling port formed at the other end of said exhaust gas recycling passage and opened into said intake passage of said internal combustion engine.

2. An exhaust gas purification system as claimed in claim 1, wherein said secondary air supplying passage has its other end opened into atmosphere through check valve means for introducing the secondary air by exhaust pulsation.

3. An exhaust gas purification system as claimed in claim 1, wherein said exhaust gas recycling passage has said exhaust gas deriving port thereof opened into an intermediate portion of one exhaust pipe of said the other exhaust pipe group of said first and second exhaust pipe groups.

4. An exhaust gas purification system as claimed in claim 1, wherein said exhaust gas recycling passage has said exhaust gas recycling port thereof opened into said intake passage at a downstream of said carburetor throttle valve.

5. An exhaust gas purification system as claimed in claim 1, wherein said exhaust gas recycling passage has said exhaust gas recycling port thereof opened into said intake passage at an upstream of said carburetor throttle valve.

6. An exhaust gas purification system as claimed in claim 1, wherein said secondary air supplying port is opened into one exhaust pipe of the one exhaust pipe group selected from said first and second exhaust pipe groups.

7. An exhaust gas purification system as claimed in claim 1, wherein said secondary air supplying port of said secondary air supplying passage is opened into said one junction of the exhaust pipes of the exhaust pipe group selected from said first and second exhaust pipe groups.

8. In an internal combustion engine having an exhaust system which includes first and second exhaust pipe groups each formed by collecting, at one junction, exhaust pipes for cylinders whose ignition sequences are not continuous, at the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air supplying passage having at one end thereof a secondary air supplying port opened into an intermediate portion of one of the exhaust pipes which belongs to said second exhaust pipe group and at the other end thereof opened into atmosphere, said secondary air supplying passage being provided with a check valve which is selectively opened by negative pressure and closed by positive pressure of exhaust pulsation developed in said one of the exhaust pipes, and a downstream exhaust gas recycling passage provided with an exhaust gas recycling control valve and having at one end thereof a downstream exhaust gas deriving port opened into an intermediate portion of one of the exhaust pipes which belongs to said first exhaust pipe group and at the other end thereof a downstream exhaust gas recycling port opened into a downstream of a carburetor throttle valve of said internal combustion engine.

9. In an internal combustion engine having an exhaust system which includes first and second exhaust pipe groups each formed by collecting, at one junction, exhaust pipes for cylinders whose ignition sequences are not continuous, of the exhaust pipes respectively connected to a plurality of cylinders, a first connecting pipe having its one end connected to said first exhaust pipe group, a second connecting pipe having its one end connected to said second exhaust pipe group, said first and second connecting pipes being collected to communicate with each other at the other ends thereof, and a lead-out pipe having its one end connected to said collected other ends of said first and second connecting pipes and having its other end opened into atmosphere, an exhaust gas purification system for use in said internal combustion engine which comprises a secondary air supplying passage having at one end thereof a secondary air supplying port opened into said one junction of the exhaust pipes which belong to said second exhaust pipe group and at the other end thereof opened into atmosphere, said secondary air supplying passage being provided with a check valve which is selectively opened by negative pressure and closed by positive pressure of exhaust pulsation developed in said one junction of the exhaust pipes, and an upstream exhaust gas recycling passage provided with an exhaust gas recycling control valve and having at one end thereof an upstream exhaust gas deriving port opened into an intermediate portion of one of the exhaust pipes which belong to said first exhaust pipe group and at the other end thereof an upstream exhaust gas recycling port opened into an upstream of a carburetor throttle valve of said internal combustion engine.

* * * * *